United States Patent [19]

Wunnenberg et al.

[11] 4,030,531

[45] June 21, 1977

[54] METHOD AND APPARATUS FOR MONITORING AND OBVIATING DEFORMATIONS OF CONTINUOUS CASTINGS

[75] Inventors: Klaus Wunnenberg, Duisburg; Joachim Dubendorff, Krefeld, both of Germany

[73] Assignee: Mannesmann Aktiengesellschaft, Dusseldorf, Germany

[22] Filed: Jan. 26, 1976

[21] Appl. No.: 652,364

[30] Foreign Application Priority Data

Feb. 4, 1975 Germany ..... 2504986

[52] U.S. Cl. ..... 164/4; 164/82; 164/89; 164/154; 164/282; 164/283 R

[51] Int. Cl.[2] ..... B22D 11/16

[58] Field of Search ..... 164/4, 82, 89, 154, 164/282, 283 R, 283 S, 150

[56] References Cited

UNITED STATES PATENTS

| | | | |
|---|---|---|---|
| 2,726,430 | 12/1955 | Rossi et al. | 164/89 X |
| 3,237,251 | 3/1966 | Thalmann | 164/4 |
| 3,478,808 | 11/1969 | Adams | 164/82 X |

FOREIGN PATENTS OR APPLICATIONS

| | | | |
|---|---|---|---|
| 47-40939 | 8/1969 | Japan | 164/4 |
| 6,704,333 | 9/1967 | Netherlands | 164/4 |

*Primary Examiner*—Ronald J. Shore
*Attorney, Agent, or Firm*—Cullen, Settle, Sloman & Cantor

[57] ABSTRACT

A method and apparatus are disclosed for monitoring and obviating deformation of the shell of continuous castings. Reference pick ups are used to measure from a reference line the bulging of the casting shell between adjacent guiding rollers and to measure the instantaneous distance of the guide rollers from the reference line. The differential between these measurements is determined and in accordance therewith the casting travel speed and/or quantity of coolant is regulated to avoid undesired bulging.

11 Claims, 2 Drawing Figures

METHOD AND APPARATUS FOR MONITORING AND OBVIATING DEFORMATIONS OF CONTINUOUS CASTINGS

The invention relates to a method of monitoring and obviating a critical deformation of the shell of continuous steel castings, and an apparatus for carrying out this method.

The quality of steel continuous castings is determined substantially by the internal structure of the casting. Internal cracks can result in segregation which result in difficulties during processing. One of the main causes of these defects is the bulging of the casting shell between the guide or supporting rollers.

The extent of the bulging is determined by installation and process parameters. The design characteristics such as the overall height, the spacing and the diameter of the supporting rollers, are fixed for a particular installation. In contrast, the speed at which the continuous casting travels, and the cooling of the casting, can be modified within certain limits.

It is known that the speed at which the casting travels and the secondary cooling can be controlled by measuring surface temperatures of the continuous casting. However, this method has the disadvantage that the bulging has to be detected indirectly and therefore without sufficient precision with such an arrangement. The influences of different temperature gradients in the casting shell and the material values of the cast steel cannot be taken into account. It is also known to detect deviations in the dimensions of the casting and to control the casting process therefrom. However, deviations of a casting from the predetermined dimensions are not any criterion for the bulging of a casting shell.

The aim of the invention is to provide a method which makes it possible to produce crack-free continuous castings, while allowing the speed at which the casting travels to be as high as possible, by determining the bulging of the casting shell, and also a method and an apparatus for detecting bulging precisely and directly.

The invention provides a method of monitoring and obviating a critical deformation of a shell of a continuously cast casting which left a continuous casting mould and is guided from the mould by a supporting section including guiding rollers and subjected to the direct action of a coolant, wherein bulging of the casting shell is measured at least between two adjacent guiding rollers situated at the solidification zone of the casting, taking into account the instantaneous position of the said at least two guide rollers, and the speed at which the casting travels and/or the quantity of coolant to which it is subjected is controlled in accordance with the degree of the bulging.

The invention also provides an apparatus for monitoring and obviating a critical deformation of a shell of a continuously cast casting which left a continuous casting mould and is guided from the mould by a supporting section including guiding rollers comprising at least two reference pickups detecting two reference points on the surface of the casting through two guiding rollers, and at least one pickup for detecting bulging of the casting between the two guiding rollers, a computer receiving the measurement values from the pickups and an indicating unit and/or a control unit for adjusting the supply of coolant to the casting and/or regulating the speed of travel of the casting receiving information from the computer.

If the installation is controlled by hand, instead of by control elements an indicating unit can be used which indicates the value of the bulging of the casting shell. It is also possible to operate simply with three measuring points, that is to say one for the bulging of the casting shell and one each for the adjacent rollers. In the present case it is possible to dispense with the computer and to work with a differential circuit arrangement. The measurement value pickup is arranged on a water-cooled plate which is used as a reference plane.

The casting bulging value is measured directly with the apparatus proposed by the present invention. In order not to exceed the critical values for the casting shell deformation at the phase boundary between solid and liquid, at every point of the installation a specific amount of allowable bulging is preset, which is determined for example on the basis of empirical values of casting shell thickness and in accordance with the spacing of the rollers. Therefore, with the use of this method it is possible to adjust the bulging so near to the allowable critical values that it is possible to operate with the highest possible casting surface temperatures and the highest possible casting speeds. High surface temperatures and small temperature gradients in the casting shell are necessary for obtaining crack-free casting surfaces.

The invention will now be described, by way of example, with reference to the accompanying drawings, in which.

Figure 1:
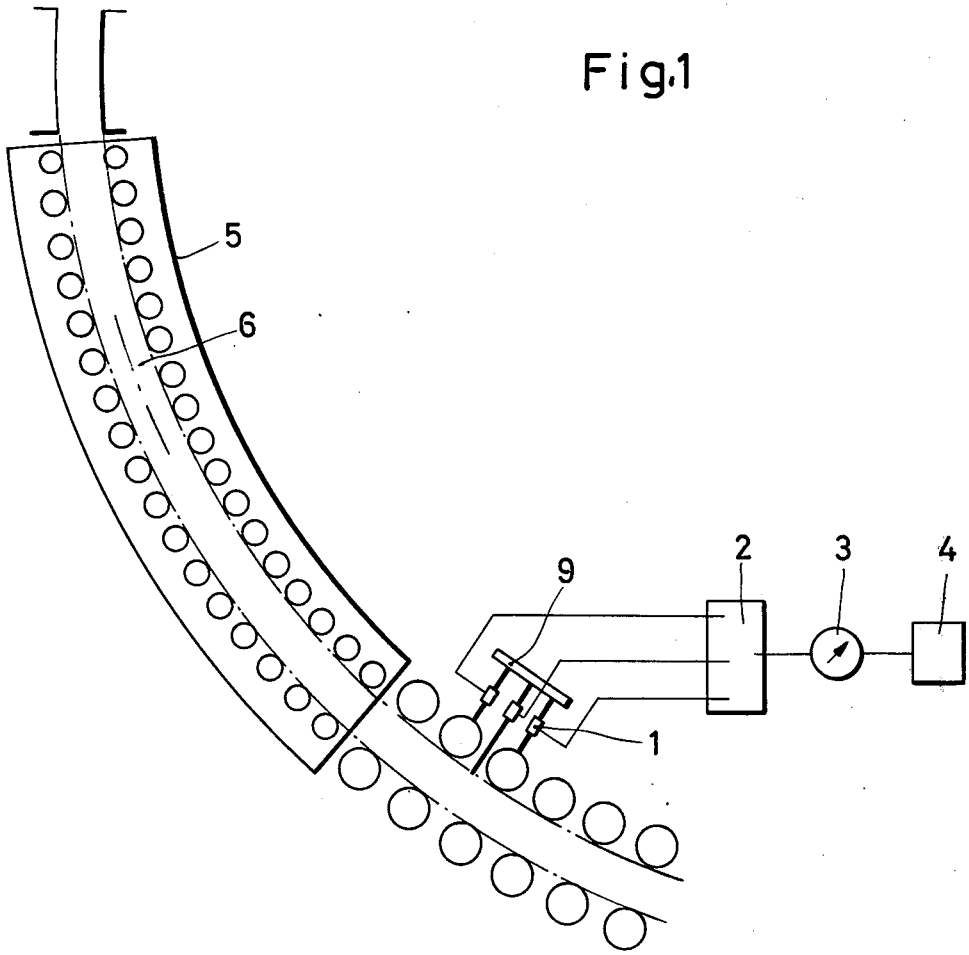
FIG. 1 shows an apparatus according to the invention and its arrangement.

The illustrated apparatus comprises three measuring pickups 1, 1', 1'' arranged along the path of the casting to be controlled near the outlet end of a cooling chamber 5 for the casting. The pickups are arranged on a water-cooled plate 9.

The values measured by the three pickups are transmitted to a computer 2, indicated on an indicating unit 3 and fed to a control unit 4 where they are used to control the coolant in the cooling chamber 5 and/or the speed at which the casting travels.

Figure 2:
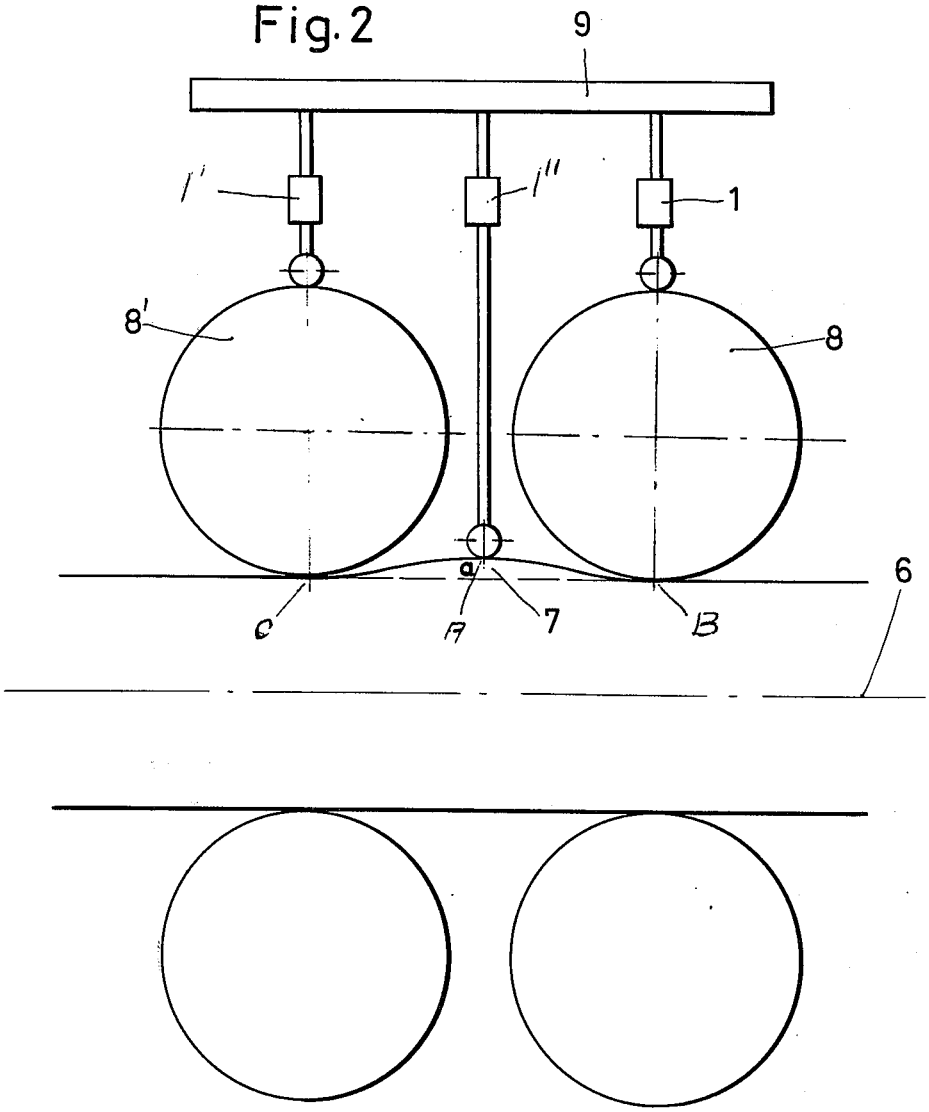
FIG. 2 shows a detail of FIG. 1 on a larger scale.

As shown in FIG. 2 the bulging 7 may be formed in the casting between two supporting rollers 8 and 8'. The two pickups 1, 1' are arranged to measure, respectively, the distance of points B and C on the surface of the casting from the axis 6 of the casting, and the pickup 1'' is arranged to measure the distance of point A on the surface of the casting from the axis 6. The distance may also be measured from another suitably selected reference line. The point A is the point of maximum deviation *a* of the surface of the casting from the desired position. All the distances are measured at right angles to the axis 6. The pickups 1 and 1' measure the distance from the points B and C via the rollers 8 and 8', respectively, and the diameters of the rollers 8 and 8' are taken into calculation. The deviation *a* from the desired position of the point A is calculated from the equation $$a = M_3 - M_1 + M_2/2$$

where $M_1$ = the value measured by the pickup 1 via the roller 8, $M_2$ = the value measured by the pickup 1' via the roller 8', $M_3$ = the value measured by the pickup 1''.

The deviation *a* is determined by an electrical differential circuit arrangement. The water-cooled plate 9 may serve as a reference plane for the pickups, and for that reason the plate 9 extends substantially parallel to the axis 6 at the points of measurement. If the bulging, i.e. the deviation *a*, exceeds the allowable critical value, the quantity of cooling water is increased to such an extent that the deviation *a* drops below the critical value. Alternatively or in addition the speed of travel of the casting can be reduced to reduce the bulging.

The apparatus enables the speed of casting to be controlled at will, the speed of travel of the casting can be increased, while the increase of the deviation *a* may be avoided by more intenstive cooling arranged by the apparatus.

We claim:

1. In the method of monitoring and obviating a critical deformation of a shell of a continuously cast casting which left a continuous casting mold and is guided from the mold by a supporting section including guiding rollers and subjected to the direct action of a coolant; which includes measuring relative to a reference line the bulging of a casting shell between two adjacent guiding rollers;

locating said guiding rollers at the solidification zone of the casting;

measuring the instantaneous distance of said guide rollers relative to said reference line;

sensing the differential between said measurements;

and controlling and regulating the speed at which the casting travels in accordance with the degree of said bulging as expressed by said differential.

2. In the method of claim 1, comparing the bulging as expressed by said differential with a preset desired value and if said value is exceeded, reducing the speed at which the casting travels so that the bulging drops to or below the desired value.

3. In the method of claim 1, comparing the bulging as expressed by said differential with a preset desired value and if the value is exceeded, increasing the quantity of cooling to which the casting is subjected, so that the bulging drops to or below the desired value.

4. In the method of claim 3, and controlling the speed at which the casting travels, keeping the bulging below the preset desired value.

5. In the method of claim 2, and increasing the speed at which the casting travels when the bulging drops below the preset desired value by more than 20%.

6. In the method of claim 3, and reducing the quantity of coolant to which the casting is subjected, when the bulging drops below the preset value by more than 20%.

7. In the method of claim 2, controlling the speed at which the casting travels and the quanity of coolant to which it is subjected, keeping the bulging below 20% of the preset desired value.

8. In the method of claim 3, determining the preset desired value of bulging when the deformation of the casting at the solidification zone is between 0.1% and 0.6%, depending on the type of metal being cast.

9. In an apparatus for monitoring and obviating a critical deformation of a shell of a continuously cast casting which left a continuous casting mold and is guided from the mold by a supporting section including a plurality of guiding rollers; said apparatus including a cooling chamber receiving coolant and including means for feeding the casting; the improvement comprising:

a pair of reference pickups spaced from one side of the casting adapted to detect two reference points on the surface of the casting through a pair of adjacent guiding rollers;

a pick up between said pair of rollers engageable with the casting surface upon the same side thereof for detecting bulging of the casting between said pair of guiding rollers;

a computer connected to and receiving the measurement values of said pickups;

and a control unit selectively adjusting the supply of coolant to the coolant chamber and regulating the speed of travel of the casting, receiving information from the computor.

10. In an apparatus for monitoring and obviating a critical deformation of a shell of a continuously cast casting which left a continuous casting mold and is guided from the mold by a supporting section including a plurality of guiding rollers;

said apparatus including a cooling chamber receiving coolant and including means for feeding the casting;

a pair of reference pickups spaced from one side of the casting adapted to detect two reference points on the surface of the casting through a pair of adjacent guiding rollers;

a pickup between said pair of rollers engageable with the casting surface upon the same side thereof for detecting bulging of the casting between said pair of guiding rollers;

a computer connected to and receiving the measurement values from said pickups;

and an indicating unit connected to said computer receiving information from the computer, permitting the selective regulation of the speed of travel of the casting and adjustment of the supply of coolant to the cooling chamber.

11. In the apparatus of claim 9, a cooled plate connected to and supporting the pickups.

* * * * *